US007780837B2

(12) United States Patent
Webb et al.

(10) Patent No.: US 7,780,837 B2
(45) Date of Patent: Aug. 24, 2010

(54) METHODS AND APPARATUS FOR CATHODE PLATE PRODUCTION

(75) Inventors: Wayne Keith Webb, Railway Estate (AU); Joanne Weston, Annandale (AU); Graham Heferen, Railway Estate (AU)

(73) Assignee: Xstrata Queensland Limited, Brisbane (AU)

( * ) Notice: Subject to any disclaimer, the term of this patent is extended or adjusted under 35 U.S.C. 154(b) by 901 days.

(21) Appl. No.: 10/554,772

(22) PCT Filed: Apr. 29, 2004

(86) PCT No.: PCT/AU2004/000550

§ 371 (c)(1),
(2), (4) Date: Oct. 2, 2006

(87) PCT Pub. No.: WO2004/097075

PCT Pub. Date: Nov. 11, 2004

(65) Prior Publication Data

US 2007/0031608 A1 Feb. 8, 2007

(30) Foreign Application Priority Data

Apr. 29, 2003 (AU) ..... 2003902048

(51) Int. Cl.
*C25D 5/02* (2006.01)

(52) U.S. Cl. ..... 205/134; 205/97

(58) Field of Classification Search ..... 205/67, 205/97, 134, 560
See application file for complete search history.

(56) References Cited

U.S. PATENT DOCUMENTS

| | | | | |
|---|---|---|---|---|
| 3,855,083 | A * | 12/1974 | Hoeckelman | 205/97 |
| 4,075,069 | A * | 2/1978 | Shinohara et al. | 205/560 |
| 6,398,939 | B1 * | 6/2002 | Huens et al. | 205/574 |

FOREIGN PATENT DOCUMENTS

| | | |
|---|---|---|
| AU | 2003227119 | 11/2003 |
| WO | WO00/39366 | 7/2000 |
| WO | WO03/093538 | 11/2003 |

* cited by examiner

*Primary Examiner*—Nam X Nguyen
*Assistant Examiner*—Luan V Van
(74) *Attorney, Agent, or Firm*—Baker & McKenzie LLP

(57) ABSTRACT

The present invention relates to electrolytic recovery of metal, and in particular methods and apparatus for producing cathode plates suitable for such electrolytic recovery. The invention provides a method of providing an electrically conductive coating on a cathode plate comprising inverting and submerging an upper portion of the cathode plate in an electrolytic bath adjacent at least one anode and applying a current to electroplate the upper portion of the cathode plate wherein each anode includes: i) a first base portion adapted to be positioned adjacent to a hanger bar of said cathode plate; ii) a second extended portion connected to and extending from the base portion and adapted to be positioned adjacent a blade of the cathode plate wherein the profile of each anode is shaped such that in use, a consistent thickness of coating is electroplated over said hanger bar and cathode blade.

8 Claims, 6 Drawing Sheets

METHODS AND APPARATUS FOR CATHODE PLATE PRODUCTION

CROSS REFERENCED TO RELATED APPLICATIONS

This application is a 371 of PCT/AU2004/00500 filed Apr. 29, 2004, which claims priority to previously filed Australian Patent Application Serial No. 2003902048 filed Apr. 29, 2003, both of which are incorporated by reference herein in their entirety.

FIELD OF THE INVENTION

The present invention relates to electrolytic recovery of metal and in particular methods and apparatus for producing cathode plates suitable for such electrolytic recovery.

BACKGROUND OF THE INVENTION

Any discussion of the prior art throughout the specification should in no way be considered as an admission that such prior art is widely known or forms part of common general knowledge in the field.

The electrolytic recovery of metal and in particular copper has been known for a considerable period of time. The first patents for metal electrorefining, were for copper and were granted to James Elkington in England in 1865. The first copper refinery was built in Newark by Balbach Smelting and Refining Company in 1883. Early electrorefineries had difficulty producing firm cathode deposits of high purity copper. The use of additives to the electrolyte, in particular salt and improved electrolyte circulation were the most important developments in overcoming the early difficulties. As the art of electrorefining grew so did the competition and it was secrets like this which were jealously guarded to retain an edge over a competitor. Even though electrolytic copper was being produced with higher purity and conductivity than fire refined Lake copper, it took many years before consumers gave recognition to this fact. Electrolytic copper became the official basis for price quotation in 1914.

During the early part of this century the industry grew rapidly with copper refineries being built throughout America, Europe and Australia. Large scale electrowinning of copper was developed between 1912-1915 at Chuquicamata Chile. As the industry grew to meet the consumer demands there were steady improvements in productivity mainly through mechanisation of the electrode handling.

The most significant change to the fundamental process of electrorefining of copper came with the development of the permanent stainless steel cathode technology, by I. J. Perry and others at the Copper Refineries Pty Ltd in Townsville, Australia in 1978.

Within a few years of its development, the permanent stainless steel cathode technology now known as the "ISA PROCESS" gained world wide acceptance and is recognised today as the bench mark for copper refining practices.

The fundamental difference between the ISA PROCESS and conventional starting sheet technologies is that the ISA PROCESS uses a permanent reusable cathode plate instead of a non-reusable copper starter sheet. The ISA PROCESS cathode plate is made of 316 stainless steel blade, approximately 3.25 mm thick which is welded to a hanger bar. In most cases the hanger bar is made of hollow stainless steel section and, to improve electrical conductivity, is encapsulated with a copper coating of the order of 3 mm thick.

The vertical edges of the cathode plate are masked with plastic strips to prevent the copper cathode growing around the edges. The bottom edge may also include a plastic edge strip, or be masked with a thin film of wax to prevent the copper enveloping the plate. After time appropriate in the electrolytic bath for deposition of copper, the cathode plate is stripped to produce two single sheets of pure cathode copper, from each side.

In some instances a V-groove may be formed in the bottom edge of the cathode blade. The resulting enveloped cathode has a flow or fracture line along the lower edge which allows the resulting enveloped cathode to be split into two pieces.

There have been a number of developments in methods and process equipment for electrorefining of metal. Much development work has concentrated on the structure and components that go to make up the cathode plate including the hanger bar, edge strips, cathode blade etc.

While the cathode plates of the ISA PROCESS are reusable, after some considerable period of use they may require repair or refurbishment. Such repair or refurbishment can be difficult particularly with certain types of cathode plates. For instance with cathode plates which have solid copper hanger bars, if the hanger bar is damaged it may be necessary for it to be removed and a new copper hanger bar to be welded to the plate.

When using a stainless steel hanger bar, with a copper cladding to improve electrical conductivity, the copper cladding may be damaged or require refurbishment. Such an operation can be difficult since it is vital that the copper cladding have a consistent thickness over the hanger bar and upper end portion of the cathode blade to ensure even and consistent electrical flow and to ensure the cathode plate sits in the correct vertical alignment in the electrolytic bath.

It is an object of the present invention to overcome or ameliorate at least one of the disadvantages of the prior art, or to provide a useful alternative.

SUMMARY OF THE INVENTION

To this end, a first aspect of the present invention provides a method of providing an electrically conductive coating on a cathode plate comprising inverting and submerging an upper portion of the cathode plate in an electroplating bath adjacent at least one anode and applying a current to electroplate the upper portion of the cathode plate wherein each anode includes:

i) a first base portion adapted to be positioned adjacent to a hanger bar of said cathode plate, ii) a second extended portion connected to and extending from the base portion adapted to be positioned adjacent a blade of the cathode plate, wherein the profile of each anode is shaped such that, in use, a consistent thickness of coating is electroplated over said hanger bar and cathode blade.

Throughout the specification the term "cathode plate" is to refer to a cathode plate comprising hanger bar and cathode blade as suitable for electrolytic recovery of metal including electrorefining and electrowinning of copper.

In a preferred embodiment each cathode plate is positioned between at least two anodes which are preferably equidistant from each cathode.

Each anode may have an identical profile, a consistent cross section throughout its length and/or be symmetrical about the plane of the cathode plate.

A second aspect of the invention provides an anode for use in electroplating an upper portion of a cathode plate having a hanger and cathode blade said anode comprising:

i) a exposed base portion being longer than said hanger bar and having a constant cross sectional profile over its length, ii) a exposed portion connected to and extending from said base portion, being shorter in length than the width of the cathode blade.

In a preferred embodiment, in use, the second portion extends in a plane from the first base portion parallel to the plane of the cathode blade. As described above, the length of the second extended portion may be slightly less than the width of the cathode blade, when in use, the ends of the exposed portion terminate short of the side edges of the cathode blade. Conversely, the ends of the first base portion extend past the free ends of the hanger bar, in use.

Preferably the first base portion extends 10-40 mm past the free ends of the hanger bar.

Preferably the second extended portions terminate 10-40 mm short of the side edges of the cathode blade.

In a preferred embodiment the anode is of constant cross-section throughout its length, and also includes shrouds or insulators adapted to alter the exposed area of the first and/or second portions of the anode along its length.

For example, the anode may be of consistent cross section throughout its length and has a length greater than the length of the hanger bar or width of the cathode plate, the desired profile of the anode being obtained by including such shields or insulators over pre-selected portions of the anode.

The above mentioned method and anode may be used for repair/refurbishment of a cathode plate, or indeed producing a new cathode plate.

The Applicants have developed a technique for electrolytically coating the upper portion of a cathode plate which is both useful for original production of a cathode plate but also for repair and/or refurbishment of used cathode plates. In particular the technique is suitable for production of a new cathode plate subject of Australian Provisional Patent Application No. PS2128 (now International Patent Application No. PCT/AU03/00519), the entirety of which is incorporated herein by reference.

By suitable formation of the anode used in electroplating, a consistent thickness of electrically conductive metal can be coated over the upper portion of the cathode plate e.g. hanger bar and cathode blade, to satisfy both the electrical requirements of the cathode plate but also to ensure appropriate seating and vertical alignment of the cathode plate when used in the electrorefining bath.

The electroplating cycle for depositing the electrically conductive metal e.g. copper can be adjusted to suit the operators needs. For instance, in some instances a thicker copper cladding over the hanger bar and cathode blade may be required. This can be accomplished by longer plating cycles or higher current densities.

When repairing or refurbishing a cathode plate, it is necessary to firstly remove the previously electroplated conductive coating. This may be accomplished by a number of techniques including manual removal or electrolytic deplating.

A third aspect of the invention provides a process for refurbishing the cathode plate comprising, following a process of removal of an electrically conductive coating on the hanger bar and the cathode blade, applying a current density to the cathode plate in a deplating bath at a level sufficient to etch the exposed metal below the solution line of the deplating bath, but insufficient to preferentially attack any weld connection between the hanger and cathode blade or end caps of the hanger bar.

In a preferred embodiment of this aspect the electrically conductive coating on the hanger bar and/or cathode plate is at least partially removed by electrolytic deplating, and the etching is accomplished by application of a current to the cathode plate, in the electrolytic bath.

With regard to this aspect of the present invention, the Applicants have found a significant advantage over conventional techniques. In conventional processes, after deplating of the electrically conductive coating, a primary base metal may be applied or "flashed" to the hanger bar and the upper portion of the cathode blade to assist in adhesion of any newly applied electroplate. Such a flash of primary base metal, is expensive from a capital equipment perspective requires a major materials movement and has both significant environmental concerns and an occupational hygiene impact.

By application of the proposed electrolytic etching technique, adhesion between the electroplated material stainless steel hanger bar/cathode blade may be improved without the need for additional capital equipment or materials. Such a new process improves occupational hygiene, environmental aspects and reduces the capital investment required to establish the repair/refurbishment process at new locations.

DETAILED DESCRIPTION OF THE INVENTION

In the following discussion the electrically conductive material to be plated on the cathode plate is copper. It would be understood, however, that a variety of other materials may similarly be electroplated over the hanger bar and upper end portion of the cathode and still fall within the broad scope of the present invention.

Figure 2:
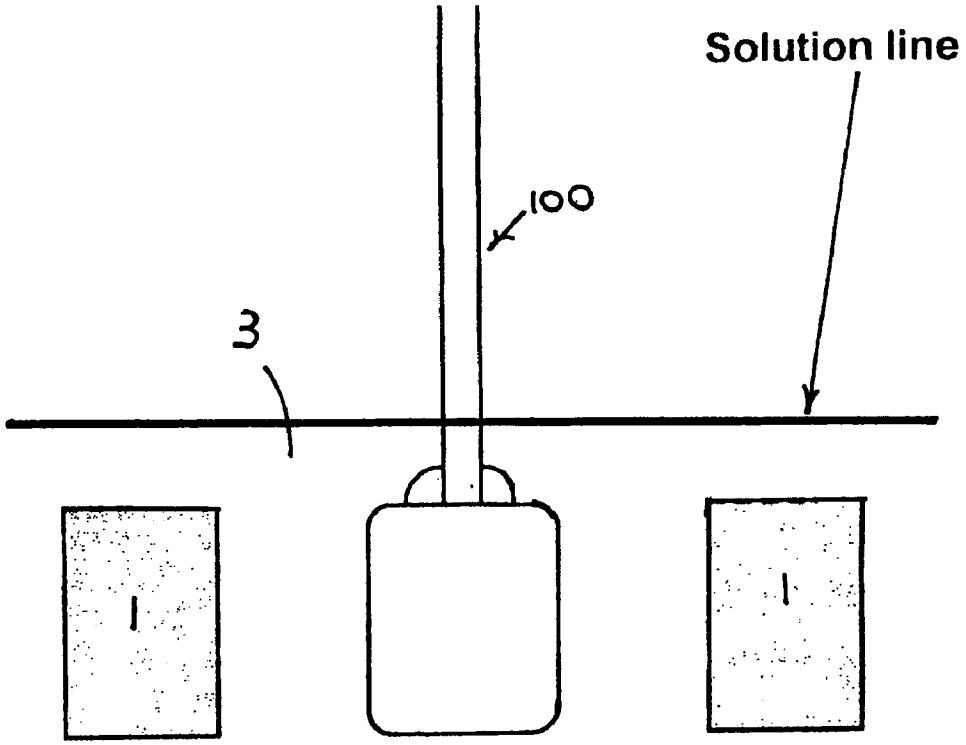
FIGS. 1 and 2 are end elevational views of a conventional anode and electroplating process, respectively.
Figure 1:
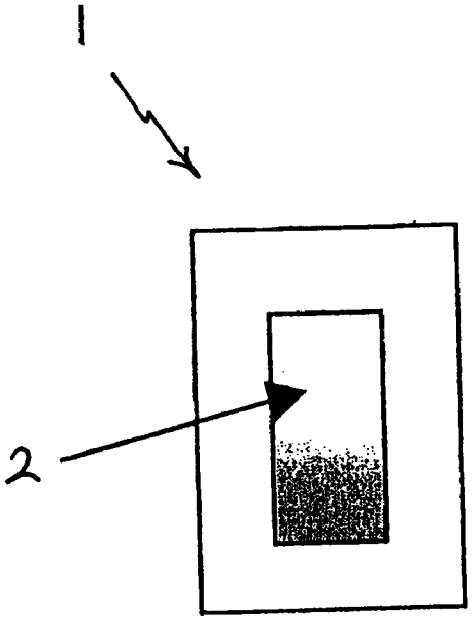

FIGS. 1 and 2 display the conventional electroplating technique used in the production of conventional ISA PROCESS cathode plates.

The standard anode 1 used in the manufacture of ISA PROCESS technology cathodes plates is lead with a copper core 2 for electrical conductivity purposes.

In the conventional technique, a series of such lead anodes are submerged in a copper sulphate electrolyte solution 3 (as shown more clearly in FIG. 2). Interspersed between a series of such anodes 1 is the top portion of a cathode plate 100. This is accomplished by inverting and supporting the cathode plate 100 in the electrolyte bath 3.

In conventional use, the hanger bar is only just submerged below the solution line of the electroplating bath since the quantity of copper plated on cathode blade is only 10-15 mm. A suitable current density is then applied to the bath to electroplate the submerged portion of the cathode plate 100 with copper.

Figure 3:
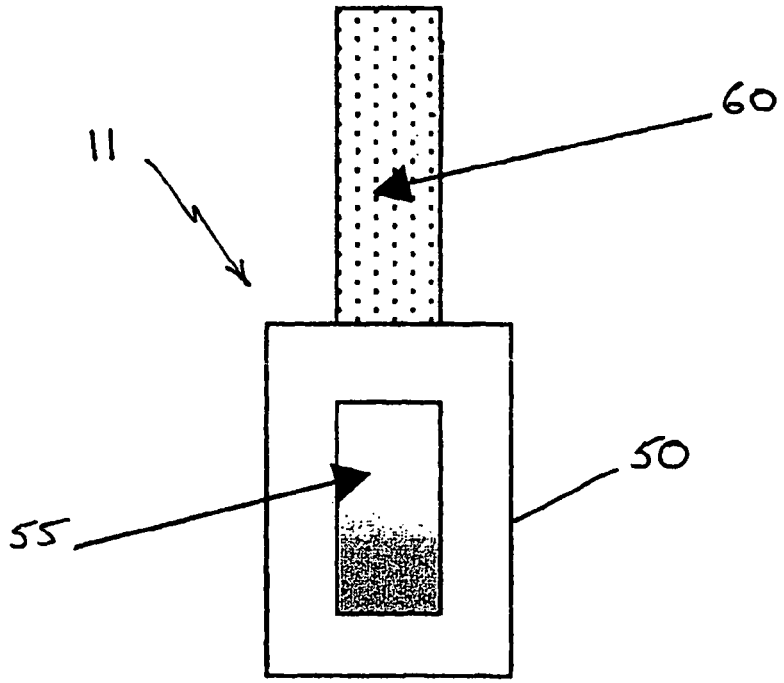
FIG. 3 is an end elevational view in accordance with first embodiment of the invention.

This system has been used for some time to produce new ISA PROCESS cathodes however it has been found somewhat difficult to use when producing or repairing cathode plates according to Australian Provisional Patent Application No. PS2128 (now International Patent Application No. PCT/AU03/00519). This cathode plate has a deeper copper coating on the upper portion of the cathode blade (i.e. around 50 to 100 mm) to reduce its electrical resistance. With such a new cathode plate, the hanger bar should typically be submerged by about 55 to 105 mm below the solution line of the electroplating bar as shown in FIG. 3. Using the conventional anode 1 with such an arrangement, however, produces a non-uniform copper deposit from the hanger bar to the solution line. Such a non-uniform copper deposit makes for an inefficient cathode which is perhaps more susceptible to the corrosion of the copper.

Accordingly, it was proposed to modify the standard anodes in the electroplating bath, by increasing the height of the anode. The modified anode 11 as shown in FIG. 3. The anode comprises a base portion 50 with copper core 55 and extended portion 60 connected along the upper surface of the base portion 50 to increase its height relative to the conventional anode. It will be noticed in this embodiment that extended portion 60 is not as wide as base portion 50. This anode design 11 was tested and found to provide good results. However, a further modified version of the anode design 12 (see FIG. 4) enables a more uniform copper coating.

Figure 4:
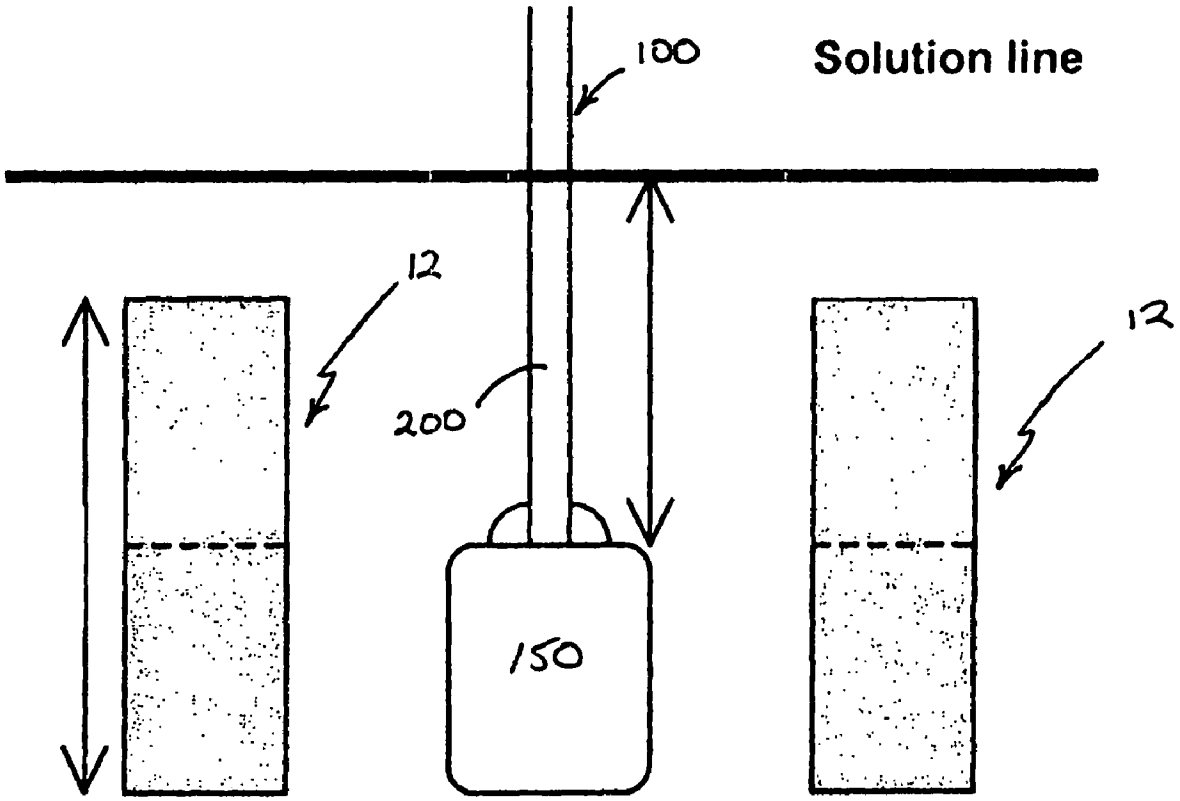
FIG. 4 is an end elevational view of an anode and an electroplating process in accordance with the second embodiment of the present invention.

Referring the FIG. 4, the new anode design 12 had an increase in height compared to the standard anode 1, but was consistent in its width. This design proved effective in providing sufficient and consistent depth of copper on the blade 200 of cathode plate 100. However, inconsistent growth of copper occurred at the ends of the hanger bar 150 and around the lifting windows of the cathode plate.

Figure 5:
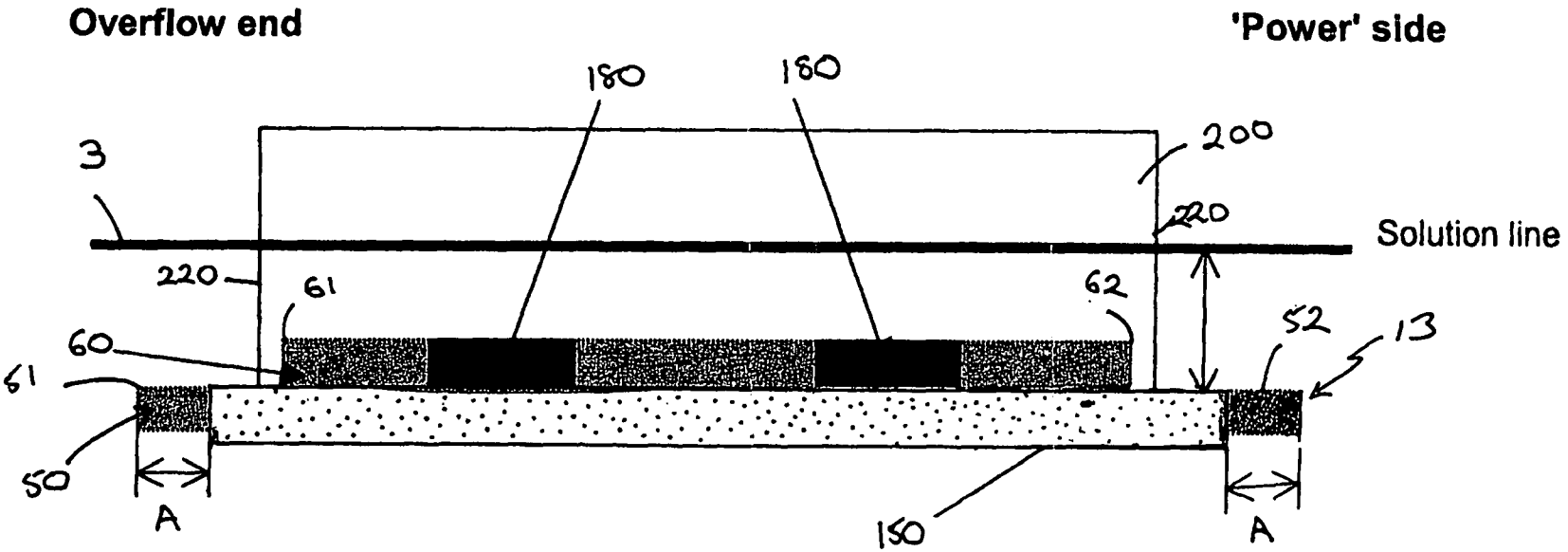
FIG. 5 is a front elevational view of an anode and electroplating process in accordance with the third embodiment of the present invention.

Referring to FIG. 5, a third embodiment of the anode 13 is shown (shaded and dotted outline) in front elevational view. This anode 13 once again comprises a first base portion 50 and second extended portion 60 attached thereto and the profile of the anode is adapted such that in use it provides consistent deposition of copper over the submerged portion of the cathode plate 100 i.e. the hanger bar 150 and upper end of the cathode blade 200.

The base portion 50 has ends 51 and 52 which extend past the lateral extremities or free ends of the hanger bar 150. This is to ensure sufficient copper growth around the free ends of the hanger bar 150. The Applicants have found however, that this overlap should be limited so as to avoid excessive copper deposition on the free ends of the hanger bar 150. In this regard, the anode is either terminated or shielded at its ends to provide the desired overlap A at each end. The desired overlap which can be obtained by simple experimentation, may be for example between 10 and 40 mm.

The extended portion 60 or the anode 13 is positioned such that in use, it is 30 adjacent the cathode blade 200. This second extended portion 60 is narrower than the blade i.e. its ends 61, 62 terminate short of the side edges 220 of the cathode blade 200. This is to ensure smooth and consistent deposition of copper around the edges 220 of the cathode blade 200 up to the depth of the electrolytic bath 3. If the second extended portion 60 was longer than the blade width, excessive copper growth could occur at the side edges 220 of the cathode blade 200.

In addition the anode, may include insulators or shields 180 to conceal portions of the lead anode. To explain, as will be known to persons skilled in the art such cathodes plates 100 include lifting windows (not shown) for positioning of the cathode plates 100 in the electrorefining bath. In order to avoid excessive or inconsistent copper plating around these windows, shields 180 are provided on the extended portion 60 of the anode 13. One shield is provided for each lifting window. Each shield 180 extends just past the side edges of each window such that the extended anode portion 60 terminates just short of the edges of the lifting windows, eg 10-40 mm. The shields or insulators 180 are preferably moulded to the shape of the anode from PVC or other suitable material. They are fitted by sliding them over the anode and positioned.

While not shown, the ends of the base portion 50 of the anode 13 may similarly be shielded with PVC insulators or alternatively simply taped to provide the required end overlap for the hanger bar.

The Applicants have found that it is possible to produce an anode which, in use, acts to ensure consistent and reliable copper deposition over both the hanger bar 150 and the upper end portion of the cathode blade 200. In use, the base portion 50 is positioned adjacent the hanger bar 150 and the extended portion 60 is positioned adjacent the upper end of the cathode blade 200. Both these portions act to provide the desired electroplate of copper over the respective portion of the cathode plate.

Initial tests were conducted with the aforementioned anodes 13 and a number of operational issues were raised. Firstly, there was a considerable quantity of acid mist generated from the electroplating bath that may have resulted in the working with a full cell load being uncomfortable for an operator.

Secondly, some of the electroplated hanger bars had unacceptable porosity believed to a result of air bubbles being trapped underneath each hanger. Accordingly, acid mist and/or air bubble suppression media may be required in some circumstances. These can take the form of liquid and/or air permeable membranes or bags fitted over the modified anodes. These bags acted to reduce the quantity of mist liberated from the electroplating cell and decrease the quantity of air bubbles reaching the cathode plate by directing such air bubbles liberated from the anode away from the bar.

An alternative to the above anode design may be a bar of consistent cross section with shields attached to the various portions of the anode to match the desired profile for the hanger and/or cathode blade.

Referring now to FIGS. 6A to 6E, another embodiment of an anode 14 is shown.

Figure 6A:
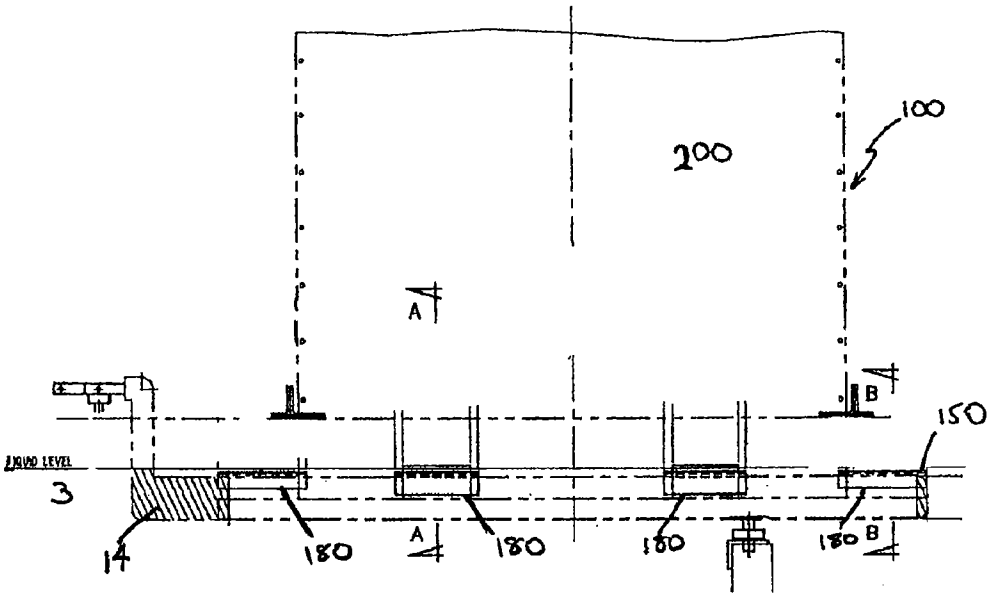
FIGS. 6A to 6E are front elevational cross-sectional views of an anode in accordance with a fourth embodiment of the present invention.
Figure 6B:
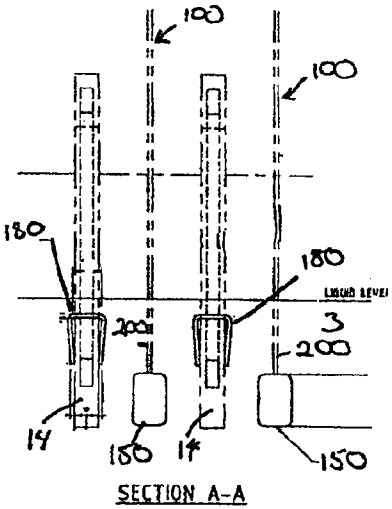
Figure 6C:
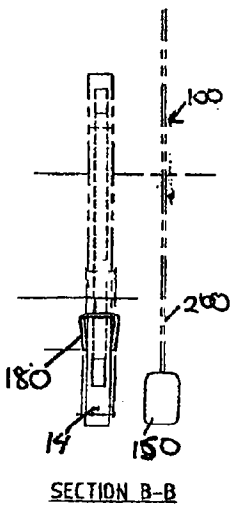

Referring firstly to FIGS. 6A to 6C, the anode 14 is shown in use in an electrolytic bath 3 adjacent one or more cathode plates 100 comprising cathode plate 200 and hanger bars 150.

In the embodiment shown, the anode 14 is of constant cross-section along its length. It includes a number of plastic shields 180 to alter the exposed area of the anode 14 to thereby provide the desired copper deposition over the hanger bar 150 and cathode blade 200, when placed in the electroplate bath, as discussed above.

The shields or clips 180 are preferably made from a resilient material, eg PVC or other suitable material such that they can be easily attached and positioned on anode 14.

Figure 6E:
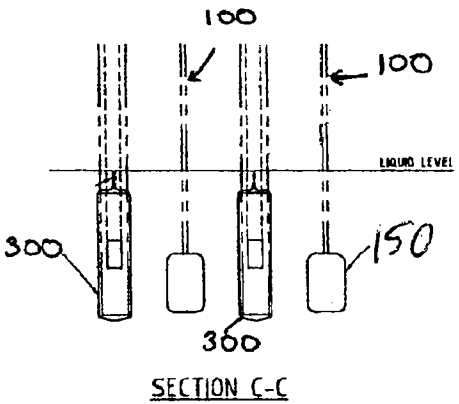
Figure 6D:
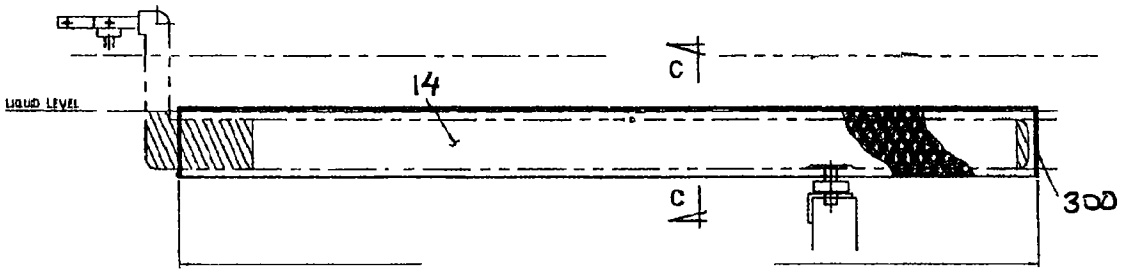

FIGS. 6D and 6E show positioning of anode bag or shroud 300 over the lead anode 14. The shroud is constructed from suitably resilient material, eg polyester woven fabric or equivalent. In the embodiment shown, the bag has its seam at the top, however, this is not essential. In a preferred embodiment, shields 180 shown in FIGS. 6A to 6C are sized, along with shroud 300, to fit over the shroud and lead anode 14. This is preferable to having the shields 180 covered by shroud 300 since, in use, the Applicants have found that during fitting shroud 300, clips or shields 180 may move on the anode 14.

With the preferred anode design various plating cycles may be used to provide the desired copper deposits. In test work, 4, 4.5 and 5 day plating cycles were used corresponding to a range of differing current densities. Current densities may range between 200-400 A/m$^2$. Previous tests have shown that lower current densities with longer plating times generally produce a smoother copper deposit. However, due to certain time constraints, the plating cycle time may be reduced and current density increased.

In test work approximately 6.5 kg of copper was electrodeposited onto the hanger bar and blade. Different cycle times for the PRC (Periodic Reversal of Current) rectifier were also trialled.

Typically, a flow rate in the range of 5-40 liters per minute through the electroplating bath may be used.

As will be appreciated by persons skilled in the art, after use of the cathode plate for electrorefining of copper, the plate may require repair or refurbishments. In some instances refurbishment is on an exchange basis i.e. the used cathode plates are returned to the original manufacture and replaced with new or "refurbished" cathode plates.

However, it would be desirable to achieve onsite repair and refurbishment of cathode plates. To date this has not proved possible.

Deplating of the copper coating over the hanger bar and cathode blade can be accomplished in a number of ways. It may be removed manually and/or it may be removed by electrolytic deplating. Current deplating cycles are around seven days with, preferably, a reduction in current density over the deplating cycle. In many instances this can be regarded as too long for refurbishment/repair.

Test work has shown that the copper electroplated coating can be removed in three days, however with such a fast deplating cycle, the quality and service life of the copper tubes, which act as cathodes in the deplating cycle, can be negatively effected.

At a test facility, the Applicant's accomplished deplating within 4.5 days with the use of a voltage clamp. A voltage clamp works such that when copper is removed from the hanger bar and the stainless steel is thereby exposed, the current reduces rather than the voltage increasing. The voltage is preferably controlled so that it does not exceed the voltage at which corrosion of welds on the cathode plate may occur.

During testing the current was decreased slowly over a 4.5 day period until all of the copper had been removed and the voltage stayed at a consistent level.

In another embodiment of the process the normal primary base metal "flash" of the hanger bars is replaced by etching. To explain, the practice of electropolishing of metals is widespread and it is conventional to "flash" a coating of primary base metal on the hanger bars prior to electroplating with copper. This is to ensure there is adequate adhesion between the copper deposit and stainless steel. Normally this operation only requires a short duration hence the term "flash". But it also requires the use of expensive capital equipment, a major materials movements and has both significant environmental concerns and occupational hygiene impact.

Accordingly, the Applicants have developed a process for electrolytic etching of the stainless steel which can be undertaken in the normal process flow of the electroplating refurbishment/repair process.

The electrolytic etching process is undertaken in the copper deplating cells. The current is continued after the effective deplating of the existing or damaged copper coating is electrolytically removed. It should be stressed that the electrolytic etching process may also be conducted after manual removal of the copper coating. It is not essential that the copper coating be electrolytically removed for the electrolytic etching process to be viable. The current density is chosen such that the effect is not to electropolish but to electro-etch the stainless steel which is exposed below the solution line in the deplating bath.

The electroetching provides a mechanical key mechanism which ensures that the copper deposited is sufficiently locked to the cathode plate that it can effectively resist the mechanical action of both the cathode flexing and stripping processes, along with the thermal cycles to which it will be exposed during its operational life.

The process parameters of the electrolytic etching process depends to a large extent on the number of cathodes and the type of equipment available. The Applicant's have, for example, tested various anodes for the electrolytic etching process, eg lead and copper. These materials, as well as others, are believed to be suitable. The Applicants have found that effective electro-etching may be obtained within reasonable periods of up to 10 hours with current densities from around 250-800 $A/m^2$. Preferably, attention is paid to rises in voltage during etching. Preferably a maximum voltage is set and monitored by means of a voltage clamp as discussed above. After etching there is a noticeable change in colour and texture of the hanger bars in the etched region.

EXAMPLES

The above described method was tested at a suitable electrolytic refining facility.

The tests were conducted on used cathode plates undergoing repair/refurbishment as well as production of new cathode plates.

Repaired Plates

Ten cathode plates at the test facility were supplied and repaired in two groups.

Group 1

Test plates 3, 4, 5, 7 and 9 were subjected to the following repair/refurbishment procedure:

i) the copper plate was removed from these hanger bars mechanically, with the use of an air operated chipping tool (sharp chisel).

ii) hanger bars were then straightened and buffed around the windows in the areas to be replated.

iii) the hanger bars were soaked in a caustic solution and the rinsed.

iv) an attempt was made to "flash" the hanger bars as per the usual procedure, however, this was not entirely successful.

v) instead the hanger bars were etched at various current densities and a minimum voltage, eg 1 Volt, sufficient to etch the exposed stainless steel on the hanger bar and upper portion of the cathode blade. Preferably, the electroplating cell was used with lead anodes, the current being reversed for the etching stage.

vi) Hanger bars were then replated for approximately 5 days.

Group 2

Cathode plates 1, 2, 6, 9 and 10 were subjected to the following refurbishment/repair process.

i) The copper plate was removed from these hanger bars mechanically, with the use of an air operated chipping tool (sharp chisel).

ii) These bars were then straightened and buffed around the windows in the areas to be replated.

New Cathode Plates

A series of new cathode plates were manufactured and plated in accordance with the present invention. Each of these plates were sandblasted to the normal height and since these new plates were in accordance with Australian Provisional Patent Application No. PS2128 (now International Patent Application No. PCT/AU03/00519) i.e. copper deposit to approximately 55 mm down the blade, each of the new plates were "cleaned" lightly with a flap disc to just below the position of the lifting windows.

These new plates were flashed with primary base metal and then electroplated for 4, 4.5 and 5 days with a current density of between 200 and 400 $A/m^2$.

Results

Group 1

The copper deposit was quite rough on the five hanger bars but was easily smoothed with the use of a flap disc grinder at the contact points and along the length of the hanger. It was however, difficult to determine a comprehensive set of thickness measurements due to the surface roughness.

Stage 2

The copper deposit on these hanger bars was considerably improved as compared with the stage 1 plates and very little grinding was required at the contact points. However, some of the hanger bars had a porous copper growth and this was believed to be due to the absence of membranes or bags around the anodes during the electroplating process to direct air away from the cathode plate. Subsequent tests have shown such anode bags or shrouds significantly reduce porosity in the electroplated copper.

New Plates

The quality of the copper deposit did not vary significantly, the only difference was cathodes plated over a period of four days were a little rough with styrations particularly at the overflow end on the contact surface.

Thickness Measurements

After the aforementioned processes copper deposit distribution was measured randomly throughout the trial plates. Copper thickness was measured with an ultrasonic panametrics meter. The overall thickness of the hanger bar was measured with vernier calipers to ensure that the ends of the bars would fit into the existing electrolytic refining cell top furniture at the test site.

The aim of the tests was to achieve an average thickness of around 3 mm as compared with the standard copper electroplate of around 2.5 mm. Measurements were taken in various positions across the hanger bar including the thickness at the free end of the hanger bar, at the position adjacent the connection with the cathode blade and thickness on and around the blade to check for any tapers.

Measurements of the various trial cathode plates produce the following. Firstly, there was sufficient copper deposit on the sides of the hanger bars in excess of 3 mm and in most cases there was sufficient copper deposit on the top and contact faces of the hanger bars.

There was a tapering effect at the ends of the hanger bars, however, this was intentional to ensure the resultant new cathode and repaired/refurbished cathode plates would fit into the existing electrolytic cell furniture at the test site. There was some inconsistency around the area of the weld, between the cathode blade and hanger bar. However, it is believed this is due to the particular anode profile used and such a difficulty can be overcome by providing an anode profile which has a consistent distance between the cathode plate, i.e. both blade and hanger bar, and the anode over the depth of the anode, eg is a stepped profile.

It will be envisaged that the production method for repair and refurbishment, anode design and electrolytic etching technique may be embodied in forms other than specifically described above without departing from the spirit or scope of the inventive idea.

The invention claimed is:

1. A method of providing an electrically conductive coating on a cathode plate comprising inverting and submerging an upper portion of the cathode plate in an electrolytic bath adjacent at least one anode, wherein the upper portion of the cathode plate comprises a hanger bar, and applying a current to electroplate the upper portion of the cathode plate wherein each anode includes:

i) a first base portion adapted to be positioned adjacent to the hanger bar of said cathode plate;

ii) a second extended portion connected to and extending from the base portion and adapted to be positioned adjacent a blade of the cathode plate wherein the profile of each anode is shaped such that in use, a consistent thickness of coating is electroplated over said hanger bar and cathode blade.

2. A method as claimed in claim 1 wherein each cathode plate is positioned between at least two anodes.

3. A method as claimed in claim 1 wherein each cathode is positioned equally distant from two anodes.

4. A method as claimed in claim 1 wherein each anode has an identical profile.

5. A method as claimed in claim 1 wherein each anode has a consistent cross section throughout its length.

6. A method as claimed in claim 1 wherein anodes positioned on either side of the cathode plate are symmetrical about the plane of the cathode plate.

7. A method as claimed in claim 1 comprising applying at least one shroud to selectively shield portions of the anode and expose only those parts of the anode adjacent areas on the cathode blade and/or hanger bar on which deposition of the electrically conductive coating is desired.

8. A method as claimed in claim 2 wherein each cathode is positioned equally distant from two anodes.

* * * * *